US006506455B1

(12) United States Patent
Bru et al.

(10) Patent No.: US 6,506,455 B1
(45) Date of Patent: Jan. 14, 2003

(54) TRIBOELECTRIC FLUIDIZDED BED METHOD AND APPARATUS FOR COATING AN OBJECT

(75) Inventors: Ariel Bru, Strasbourg (FR); Ion Inculet, London (CA); Arnaud Tedoldi, Etainhus (FR)

(73) Assignee: Atofina (FR)

( * ) Notice: Subject to any disclaimer, the term of this patent is extended or adjusted under 35 U.S.C. 154(b) by 0 days.

(21) Appl. No.: 09/762,936

(22) PCT Filed: Jun. 8, 2000

(86) PCT No.: PCT/FR00/01580

§ 371 (c)(1),
(2), (4) Date: Jun. 7, 2001

(87) PCT Pub. No.: WO00/76677

PCT Pub. Date: Dec. 21, 2000

(30) Foreign Application Priority Data

Jun. 15, 1999 (FR) ..... 99 07557

(51) Int. Cl.[7] ..... B05D 1/22

(52) U.S. Cl. ..... 427/459; 427/461; 427/185; 118/634; 118/DIG. 5

(58) Field of Search ..... 427/459–461, 427/185; 361/226; 118/634, DIG. 5

(56) References Cited

U.S. PATENT DOCUMENTS 4,018,185 A * 4/1977 Myers
4,101,687 A * 7/1978 Knudsen
6,280,798 B1 * 8/2001 Ring et al.

FOREIGN PATENT DOCUMENTS

| | | |
|---|---|---|
| DE | 19529060 | 2/1997 |
| DE | 19631241 | 11/1997 |
| DE | 19631241 A * | 11/1997 |
| EP | 0367653 | 5/1990 |
| FR | 1338913 | 1/1964 |
| FR | 2514670 | 4/1983 |
| GB | 2068783 | 8/1981 |

OTHER PUBLICATIONS

R. Feldmann: "Kunstoffpulver schonen umwelt and material" TECHNISCHE RUNSCHAU., vol. 77 No. 4, Jan. 1985, p. 22–25 HALLWAG VERLAG. BERN., CH ISSN: 1023–0823 p. 24 left–hand column line 43—p. 25 left–hand column line 36.

* cited by examiner

*Primary Examiner*—Fred J. Parker
(74) *Attorney, Agent, or Firm*—Millen, White, Zelano & Branigan, P.C.

(57) ABSTRACT

The present invention relates to as triboelectric fluidized bed method and apparatus for coating an object with powder prior to heating to form a coating. The methods includes arranging a bed of fluidixed powder in a vat where the powder can be charged by a tribocharging device such as a honeycomb comprising prisms or vertical tubes open at both ends.

18 Claims, 4 Drawing Sheets

TRIBOELECTRIC FLUIDIZDED BED METHOD AND APPARATUS FOR COATING AN OBJECT

FIELD OF THE INVENTION

The present invention relates to a method for covering an object with a film resulting from the melting of a thin layer of powder previously deposited on the object and to the apparatus for implementing this method. The issue is more particularly one of covering all kinds of objects using powder in a fluidized bed. The fluidized bed contains powder with which the object is to be covered. This powder is in the form of small-sized solid particles, for example particles of between 0.01 and 1 mm, of any shape, which are in a state of fluidity within a bed in the presence of air or any other gas.

There are currently a number of coating methods in existence on an industrial scale.

The first is electrostatic powder coating; this consists in charging the powder with static electricity and bringing it into contact with the object that is to be covered, which object is connected to zero potential. For example, the powder kept in the fluidized state is injected into an electrostatic spray gun which will charge the said powder by a corona effect, by triboelectrification or by a combination of the two. The powder thus charged is sprayed onto the object to be covered, which object is connected to zero potential. Coating will be along the electric field lines. Because of this, it will be difficult to achieve coverage in areas exhibiting Faraday cages, such as intersections or hollow parts. Furthermore, a great deal of powder is not deposited on the object and has therefore to be recycled. The object covered with powder is then placed in an oven at a high enough temperature that coating can be achieved by melting the powder, causing it to form a film. For example, for a polyamide 12 powder it is necessary to heat to 200° C.

The second method consists in preheating the object that is to be covered to a temperature above the melting point of the powder. Once hot, the object is immediately immersed in a fluidized bed; the powder melts in contact with the hot object and forms a film. A solid covering is thus ensured. In this method, a hot object is dipped into a cold fluidized bed and in order to combat heat loss it is necessary to have an oven at a temperature which is far higher than the temperature required for film forming, this leading to increased energy consumption. However, all the powder is retained within the bed and coverage is not affected by regions exhibiting a Faraday effect. The thickness depends on the shape of the object and may sometimes not be completely uniform. The present invention relates to electrostatic powder coating.

PRIOR ART

There are in existence conventional electrostatic fluidized beds such as those described, for example, in patent U.S. Pat. No. 4,381,728, in which electrodes raised to very high potentials are arranged. In such electrostatic fluidized beds, the particles are charged by a corona effect which consists in ionizing the air near to a spiked point and therefore in electrically charging the particles in this region. The object that is to be coated is immersed in the fluidized bed. Good coverage is obtained in such beds but there is a certain danger associated with the presence of electrodes at high potential which may cause electrical arcing with the object that is to be covered.

To avoid any electric arcing between the electrode and the object that is to be coated, it is possible to place this electrode under a porous slab as described in patent GB 1,487,195.

One drawback with these conventional corona-charged electrostatic fluidized bed systems lies in the fact that the deposition of powder is not uniform. In particular, the concave parts of an item are difficult to access. U.S. Pat No. 4,689,241 describes limitations such as insufficient thicknesses in the Faraday cages formed by the object that is to be covered. Finally, a difference in thickness of the powder deposit is observed between the parts furthest from the charging electrode. Other descriptions of corona-effect conventional electrostatic fluidized beds are to be found in "Electrostatic fluidized bed, theory, design, application", American Paint Journal 1972, 57(11) 53–5, 66, 68, 70–2 and in "ANTEC, 15 Conference Proceedings (Part 2)", Society of Plastics Engineers, 1994—Brookfield, Conn., USA—page 2329, 2331.

Alternative solutions have been proposed in response to these problems. Patent WO 96 11061 describes a charging system which does not use a corona effect but which works by induction. However, this technique is still applicable only to powders of low resistivity.

The publication "Triboelectrification of polymer powders in a fluidized Bed", Power Engineering; Journal of the Academy of Science of the USSR, Vol. 19, No. 6, page 75–83, describes a triboelectric charging system, but which is nonetheless assisted by electrodes connected to a high voltage.

Finally, the publication "Charge of powdered paint according to a triboelectric mechanism during its fluidisation", Journal Lakokras, Mater. IKH Primen (1979), (4), 30–2, describes the triboelectric charge in a conventional fluidized bed on the walls of the vat. However, it discloses the limitations of the electric charge over time on account of powder particles covering the walls from as early as the first moments of fluidization.

BRIEF DESCRIPTION OF THE INVENTION

The method of the invention uses a tribocharging device other than the walls of the vat and does not use electrodes connected to a source of electrical energy.

Thus, the present invention is a method for covering an object with a film resulting from the melting of a thin layer of powder, in which method:

(a) a bed of electrostatic fluidized powder is arranged in a vat, this powder being charged essentially by a tribocharging device other than the walls of the vat and located in the vat and/or outside the vat, (b) the object, connected to zero or sufficient potential, is dipped into the vat in order to cover it with powder, (c) the object, covered with the powder, is then placed in an oven at a high enough temperature that the coating film can be obtained by melting the powder.

This is an electrostatic fluidized bed tribocharged essentially using a device other than the walls of the vat. The powder is tribocharged; a high volumetric charge density is thus created within the fluidized bed. The powder is charged and fluidized. If an object that is to be covered, connected to zero or sufficient potential, is plunged into the charged bed, there will be an electric field created by the charged volume of powder. This will contribute to good electrodeposition on the earthed object. The dipped object can be at a positive, negative or zero potential. Advantageously the tribocharging device is a honeycomb.

In this invention, the powder is tribocharged, that is to say charged by contact or friction. Friction is provided by the fluidization air or gas which carries the particles of powder and allows these to come into contact with the tribocharging systems which will be described hereinafter. The charging system described in this application is autonomous and requires no supply of energy other than the gas used to fluidize the powder.

The present invention also relates to the apparatus for implementing the method.

DETAILED DESCRIPTION OF THE INVENTION

The objects that can be coated may be of any kind provided that they can be plunged into the fluidization vat and withstand the temperature of the oven. By way of example, mention may be made of metals such as aluminium, aluminium alloys, steel and its alloys. The invention can be used particularly for metal dishwasher baskets.

As far as the powders are concerned, these consist of a substance which, through heating, will form a film to protect the object. By way of example, mention may be made of polyamides, polyolefins, epoxies and polyesters.

Polyamides are to be understood as meaning the products of condensation:

- of one or more amino acids, such as aminocaproic acids, 7-aminoheptanoic acid, 11-aminoundecanoic acid and 12-aminododecanoic acid, of one or more lactams, such as caprolactam, oenantholactam and lauryllactam;
- of one or more salts or mixtures of diamines such as hexamethylenediamine, dodecamethylenediamine, metaxylyenediamine, bis(p-aminocyclohexyl)methane and trimethylhexamethylenediamine with diacids such as isophthalic acid, terephthalic acid, adipic acid, azelaic acid, suberic acid, sebacic acid and dodecanedicarboxylic acid;

or mixtures of all these monomers which lead to copolyamides.

Polyolefins are understood as meaning polymers comprising olefin units such as, for example, units of ethylene, propylene, 1-butene, etc.

By way of example, mention may be made of:

- polyethylene, polypropylene, copolymers of ethylene with alpha-olefins, it being possible for these products to be grafted by unsaturated carboxylic acid anhydrides such as maleic anhydride or unsaturated epoxides such as glycidyl methacrylate.
- copolymers of ethylene with at least one product chosen from (i) unsaturated carboxylic acids, their salts, their esters, (ii) the vinyl esters of saturated carboxylic acids, (iii) unsaturated dicarboxylic acids, their salts, their esters, their semi-esters, their anhydrides, (iv) unsaturated epoxides, it being possible for these ethylene copolymers to be grafted by unsaturated dicarboxylic acid anhydrides or unsaturated epoxides.

Particularly preferred substances are polyamide 11 and polyamide 12. The powder size is advantageously between 0.01 mm and 1 mm.

A "thin layer of powder" is to be understood as meaning a thickness of up to 2 mm and advantageously of between 0.1 and 0.6 mm.

The fluidized bed is sized in such a way as to completely immerse the item that is to be covered. Its shape is of little importance provided it contains the necessary volume of powder, and provided that the item to be covered can be completely immersed and provided that fluidization is correct.

To choose a material to tribocharge the powder correctly, an initial choice may be made by comparing the work functions of the powder and of the envisaged material. This can be done by looking at the values of the work functions in electron volts of the two compounds concerned and by looking at their respective positions in a triboelectric series. The greater the difference: |Wf powder−Wf material|, the more readily the powder will charge. It is recommended that this value be greater than 0.5 eV in absolute terms. "Wf" denotes the work function; these values are read from triboelectric series tables such as, for example, ELECTROSTATICS by J. A. CROSS, IOP Publishing, 1987. Lower values may be considered, in the sure knowledge that the tribocharge will consequently not be as good and the coverage therefore less effective.

However, these values are merely theoretical and the fact that a good tribocharge is obtained between the material and the powder may be verified by performing the experiment described by I.I. Inculet et al. in U.S. Pat. No. 5,289,922 and which consists in tribocharging the powder in a rotary cylinder made of the tribocharging material and then measuring the charge obtained. Using this type of test, if the ratio Q/m (specific charge) obtained with the powder is higher, in absolute terms, than $0.5\times10^{-6}$ C/kg then the charge per unit volume that will be obtained in a bed larger than the object that is to be coated will be high enough. It is always possible to test out materials which give lower values in the certain knowledge that the coverage will be thereby affected. By way of example of tribocharging materials, mention may be made of PVC, PTFE and stainless steel.

The powder is charged by triboelectrification, that is to say by friction or contact with a material which is a good tribocharger. The tribocharging material is chosen according to the above-defined criteria. There are a number of envisageable tribocharging solutions:

- Friction by a circulation of powder outside the bed, through a device made of a suitable material which is a good tribocharger of the powder. The powder is tapped off from the bed and then reinjected once it has been charged.
- Friction over beads or granules of an appropriate material which is a good tribocharger of the powder, which are present within the bed. Their area for contact with the powder is very large. To ensure closer contact it is preferable to adapt their density. It is possible, in conjunction with this, to use another type of beads which are conducting or semi-conducting so as to dissipate the charge of opposite polarity which builds up on the insulating beads made of tribocharging material.
- Friction over a "honeycomb" device located in the vat; this device is described in detail further on in this text.

It would not be departing from the scope of the invention if a tribocharging material were also arranged on the walls of the vat, this being merely in addition to the main tribocharging device.

The area for contact between the powder and the tribocharging material can be increased. For example, modifications may be made in this way by altering the surface roughness or by sticking tubes or half-tubes onto the walls. It is also possible to add a system of vibrating baffles at the bottom of the bed or a system made up of any other object present in the bed and which does not disturb the fluidization and provides good tribocharging.

It is important to mention that it is possible to combine a number of the above-described techniques. It is also possible to combine a number of materials.

Advantageously, use is made of a "honeycomb" (see FIGS. 1 and 2). This is a structure made up of geometric elements the cross section of which may range from any kind of polygon (the elements are then prisms) to a circle (the elements are then tubes). These elements are hollow, have a thickness preferably of between 1 and 10 mm; their length is, for example, between 15 and 25 cm. These tubes are stuck together to form a solid and uniform assembly. The gaps between tubes are plugged by any means such as sheets of aluminium. Although any kind of polygonal cross section may be envisaged, the cylindrical structure is preferable. A cylindrical geometry is preferred in order to allow uniform fluidization. Edge effects will be limited by an appropriate length of the tubes which form the honeycomb, that is to say that these tubes are advantageously more than 15 cm long.

The outside of the tubes is advantageously covered with a metallic paint or any other conducting material and connected to zero or sufficient potential to remove the charges. The advantage of this solution is that it will allow a tribocharging of the powder which is continuous over time. What happens is that by friction against the material, the powder acquires a given charge, the material becomes charged with the opposite polarity. However, in order to have a continuous charge phenomenon, the charges of opposite polarity to that of the powder and which build up on the interior walls of the tubes have to be removed. These charges will, in fact, be removed to the conducting outside of the tube and advantageously to earth. This allows for permanent availability of the tribocharging area.

To increase the efficiency of the honeycomb it is highly advisable to pierce a great many small holes at right-angles to the tube so as to proliferate the paths for the removal of charges from the inside to the conducting exterior surface. These small holes may be of diameter of between 0.05 and 2 mm.

Another solution consists in including, within the thickness of the material of which the tribocharging tube is made, conducting elements which are electrically connected to the metallic paint or to the conducting material itself which is electrically connected to an earth.

This "honeycomb" is arranged at the bottom of the bed (see FIG. 3). It must leave sufficient space at the top of the bed for the object to be immersed and provide, around the said object, a volumetric charge density which is high enough to ensure electrodeposition.

The "honeycomb" is placed as low down in the bed as possible, so as to optimize contact in the tubes without, however, disturbing fluidization. The tube diameter is chosen to be as small as possible so as to increase the contact area, but it is nonetheless necessary to make sure that the tubes will not become clogged and that they are therefore wide enough to allow correct fluidization. The longer these tubes, the better the electric charge generated on the powder particles will be, although the space that has to be left for dipping the article imposes a limitation on this length. By way of example, use may be made of tubes 25 mm in diameter and 150 mm long. The tubes are advantageously made of PVC.

As can be seen in FIG. 3, the air or the chosen fluidization gas is injected into a wind box placed under the bed. The air then passes through a porous substance or grating or perforated metal plate, the pressure drop across which is chosen to ensure that the powder is correctly fluidized. The air speed used is between Umf, the minimum fluidization velocity, and Umb, the minimum bubbling velocity. It is not advisable to operate well above Umb because this causes bubbling and causes fine charged particles to be thrown out of the bed. It is necessary to operate above Umf so that the object that is to be covered with the powder can be introduced effortlessly.

By way of example, the applicant company produced a honeycomb by juxtaposing PVC tubes 2.5 cm in diameter, of standard thickness and 15 cm long. Each tube was externally covered with a coat of conducting paint. This honeycomb, of a cross section equivalent to that of the fluidized bed used for the covering, was placed. This bed had dimensions equal to 40 by 40 cm, and 60 cm tall. The "honeycomb" was positioned a distance of 5 cm above the fluidizing-air distributor.

Calculations make it possible to ensure that, using the envisaged system, the bed would have and be supplied with enough electric charge to allow objects to be covered at an industrial rate.

Example: production of dishwasher baskets covered with polyamide 11 with a particle size of 200 $\mu$m sold under the trade name RILSAN® by the applicant company. An ammeter was placed between the "honeycomb" and earth; measuring the current gives information about the amount of charge generated in the bed; in this instance, the tribocharge on the walls of the bed or on any surface other than the "honeycomb" was not taken into account. The mass of powder deposited on a conventional dishwasher basket is: 130 g. The charge acquired by a triboelectrification in this bed was $0.5\times10^{-6}$ C/kg. Each covered basket therefore requires a charge of $0.065\times10^{-6}$ C. An industrial dishwasher basket production line manufactures 1 basket or multiple of 1 basket every 10 seconds. This multiple depends on the configuration of the line and on the size of the fluidization vat. At a rate of 1 basket every 10 seconds, $0.065\times10^{-6}$ C. are drawn, namely a continuous current of $6.5\times10^{-9}$ amperes. It is therefore necessary that the current supplied is equal to this, or preferably higher. In our example, we measured a maximum of $10\times10^{-9}$ amperes. According to a particular form of the invention, operations were performed at low temperature. As discharge dynamics are minimized at low temperature, the bed described above was surrounded with a casing containing a cold fluid or any other means of cooling the bed. Within the meaning of the present invention, the expression "low temperature" means a temperature of below 20° C.

It is also possible to use cold, that is to say below 20° C., air or fluidizing gas. According to another embodiment of the invention, the air or fluidizing gas can be blown. This is because if the air speed is high the powder/material friction is greater, and this increases the amount of charge supplied to the bed. By contrast, when an object is immersed, a greater volumetric charge density is needed in order to ensure maximum electrodeposition, and this entails a low fluidization velocity, but one which nonetheless maintains the fluidized state. A bed may be fluidized at a velocity of below Umf, by adding vibration to this velocity. It is thus possible to create a state which is agitated and then calm at the time of immersion and so on.

According to another embodiment of the invention, a vibrating mechanism is used to dislodge the particles of powder which remain attached to the tribocharging surfaces.

According to another embodiment of the invention, the electric charge created within the bed by the tribocharging material consists in reducing the humidity of the fluidization air. This constitutes a simple and effective method of improving the electrodeposition. This reduction in humidity is achieved by an air drier or by compression.

FIG. 4 depicts an industrial plant according to the present invention.

According to another form of the invention, a surface pretreatment is given to the object before it is brought into the bed. This may be a conventional pretreatment used in the plastic-coating industry: phosphate plating, degreasing, shot peening, application of liquid or powder primer, etc. This list is not exhaustive. The objects that are to be covered are brought in by an earthed conveyor. The powder is then charged in the tribocharged bed described earlier. During dipping, electrodeposition occurs. It is important that the item be agitated in a sustained way to a greater or lesser extent according to the level of charge in the bed. This agitation may be performed by small hammers present on the conveyor or by any other system. A tapping system allows surplus powder to be removed as the object leaves the fluidized bed.

By virtue of this system and this method, it is thus possible to powder-coat non-metallic objects such as wood or plastic.

In the case of covering powders which require a primer, this primer may be applied to the object beforehand before it is dipped in the vat of fluidized powder, and this primer may be a liquid or solid primer.

In the case of a solid primer, this may be applied by electrostatic powder coating, corona-effect spray gun, tribopowder coating or both. It is also possible to apply the primer using a tribocharged bed. The particles of primer are of very small size and the primer cannot therefore be fluidized on its own. However, if the primer is mixed, in a first bed, with the powder with which the object is to be covered, using a primer content of at least 1% by weight (compared with the weight of powder) and preferably of 5 to 10% by weight, then the small particles of primer can be fluidized by the large particles of fluidization powder. This first tribocharged bed is of the same type as those described previously. The charge acquired by a particle is more or less inversely proportional to its radius. The small more highly charged particles of primer will therefore constitute most of the electrodeposit. The object will thus have been coated with a solid primer. The object is then coated with a second coat in a tribocharged bed containing the coating powder alone. During operations with primer it is possible, if desired, to perform a first baking of this primer; it is also possible to avoid this intermediate baking and carry out the second covering operation and then carry out an overall bake.

Once the object has been covered in the bed, it is conveyed into an oven (see FIG. 4) where baking is performed. Depending on the geometry of the object, the properties of the powder and the desired rate of production, it is possible to use either a convection, infrared or induction oven.

The method of the present invention is particularly useful for polyamide powders, and what is more, it is extremely safe. Explosivity tests have been performed on this tribocharged bed. For a tribocharged polyamide bed, high potentials (30 kV) were applied, and high energies (1 joule) were discharged into the bed whereas the powder ignition energy is a mere few millijoules. Arcing in the air was observed in the bed, and sparks appeared. No explosion could be caused.

The key to these numerals is given below:

1: Metal coating (may possibly be mixed with adhesive).
2: Tubes, made of a tribocharging material.
3: Aluminium paper.
4: Honeycomb structure.
5: Powder particles.
6: Fluidized bed, made of an appropriate material.
7: Air box, the material is unimportant.
8: Porous slab.
9: Object to be covered.
10: Conveyor.
11: Pre-treatment of the objects to be covered (to be defined to optimize the quality of the covering).
12: Heat treatment oven to turn the covering into a film.
13: Air inlet.
14: Isolating base placing the bed above the ground.
15: Ammeter connected to the honeycomb.

Figure 1:
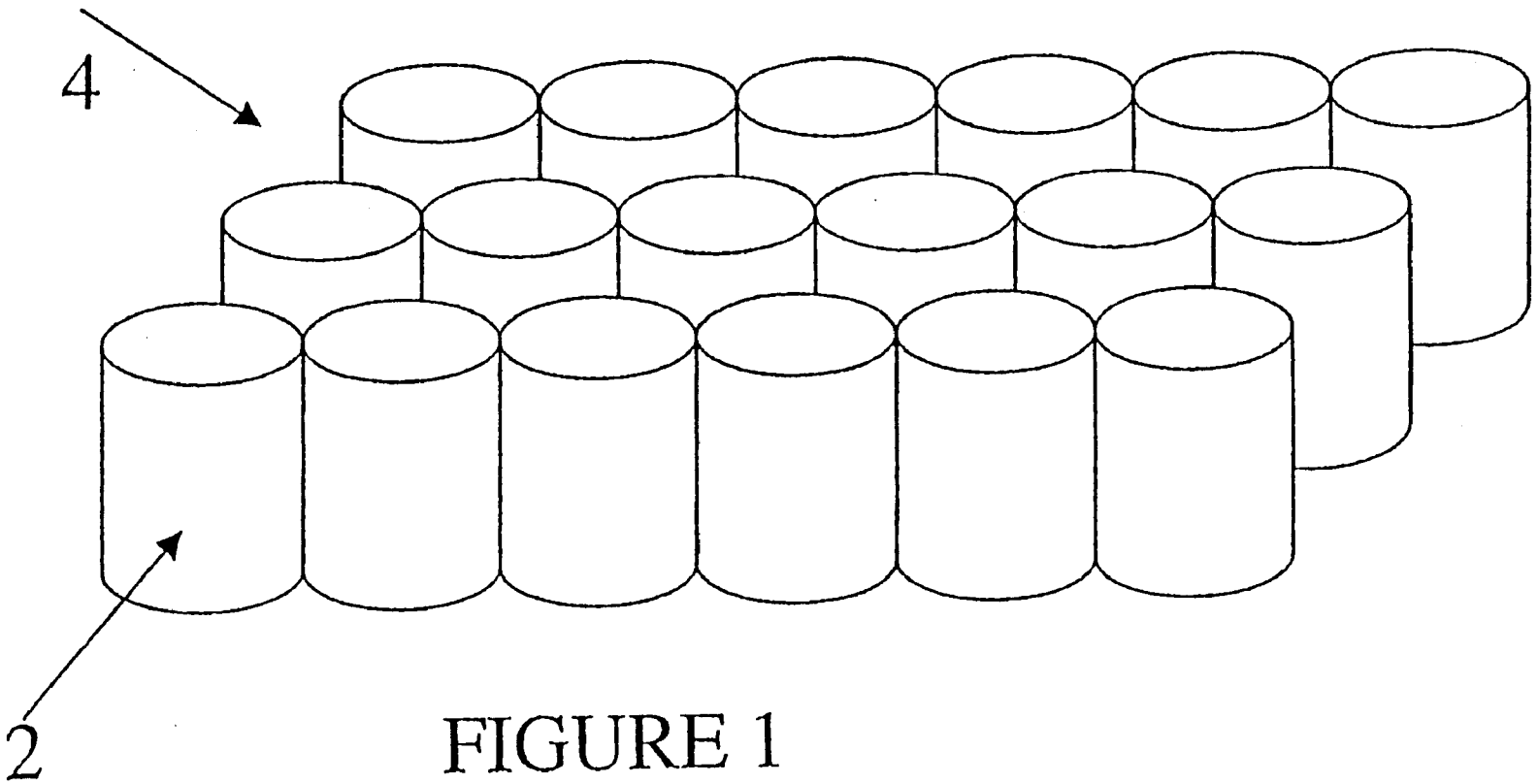
FIGS. 1 to 4 depict the covering system in which the key elements are numbered from 1 to 15.

FIG. 1 shows a perspective view of 4, the "honeycomb" structure.

Figure 2:
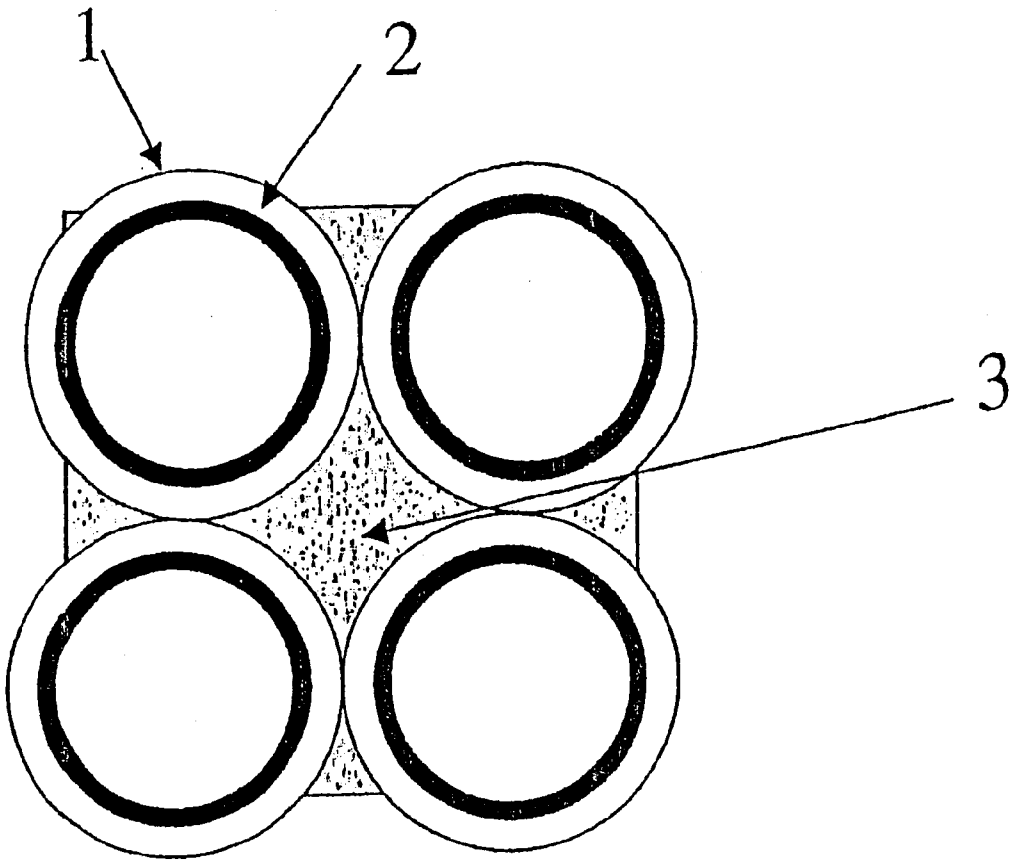

FIG. 2 shows a view from above of this "honeycomb" structure.

Figure 3:
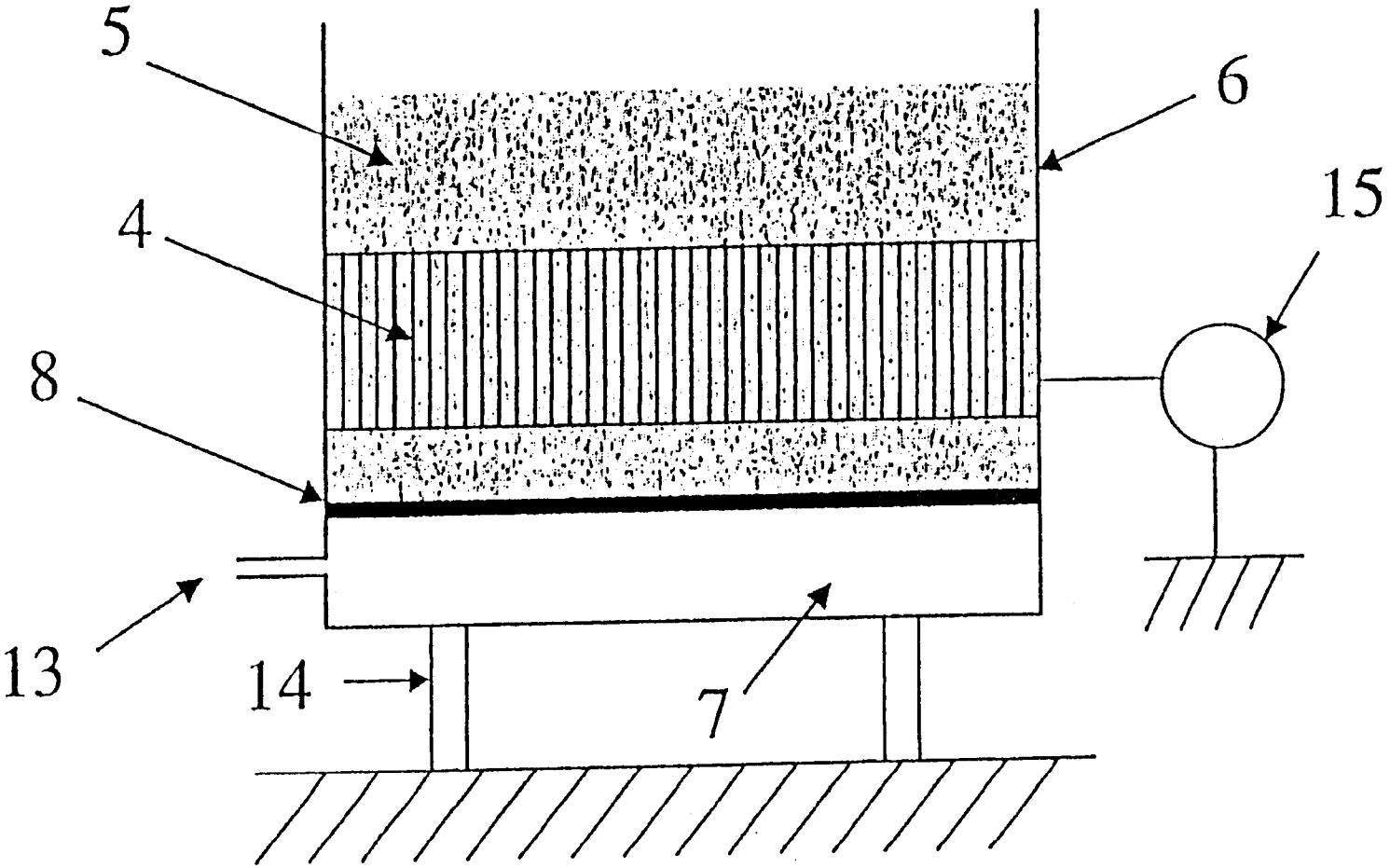

FIG. 3 details the fluidized bed in which the powder is fluidized and tribocharged.

Figure 4:
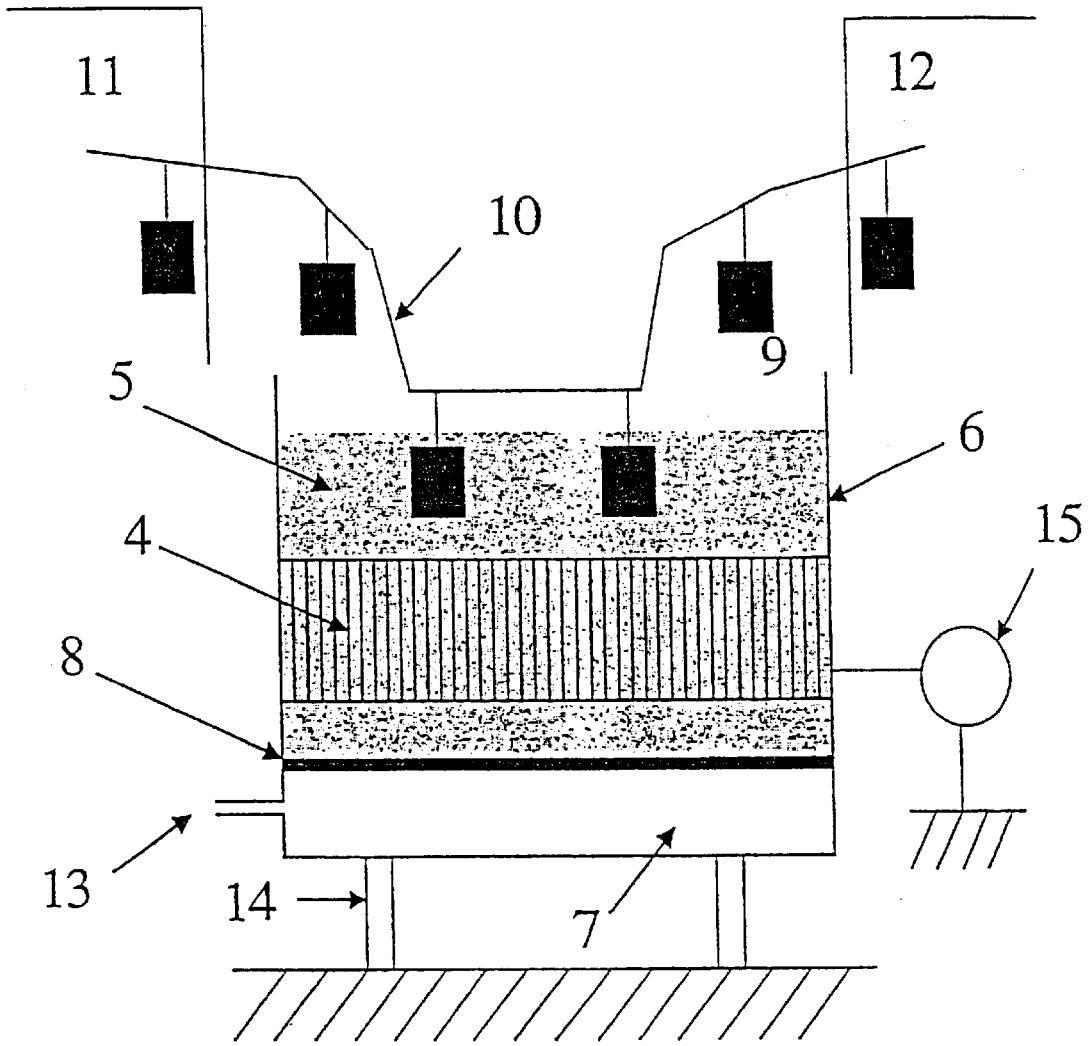

FIG. 4 is an overall view of the covering system which carries out coating according to the present invention.

FIGS. 1 and 2 detail the "honeycomb" structure. This structure 4 is made of tubes of an appropriate tribocharging material. The exterior surface and the ends of the tubes 2 are metallized or covered with a conductive coat 1. 1 is earthed as can be seen in FIGS. 3 and 4. The tubes 2 are bonded together by virtue of the metallic paint 1 or a little adhesive. The gaps between the tubes 2 are plugged with aluminium paper 3.

FIG. 3 depicts a fluidized bed 6 made of an appropriate material, supported and isolated from the ground by the base 14. Cooled or otherwise and/or dried or otherwise compressed air or any other fluidization gas is introduced into the air box 7 by a pipe 13. The air then passes through the porous slab 8 which is mounted horizontally right by the bed and placed between the bed 6 and the air box 7 which are themselves screwed. Arranged horizontally a certain distance above the porous slab 8 is the honeycomb structure 4. This honeycomb structure is the one which will perform most of the tribocharging of the powder 5 in the fluidized bed 6. The honeycomb structure 4 is earthed. The ammeter 15 monitors the level of charge.

FIG. 4 shows that the objects 9 that are to be covered, earthed via the conveyor 10, leave the pre-treatment zone 11, where an appropriate pre-treatment is performed, before being conveyed to the fluidized bed 6 by the conveyor 10. The conveyor 10 conveys the objects 9 into the tribocharged fluidized bed 6; it is also possible to bring the bed 6 to the objects 9. The objects 9 therefore completely enter the tribocharged fluidized bed and electrodeposition of powder 5 therefore takes place using sufficient quantity of powder to ensure good coverage. The conveyor 10 continues to move and the objects 9 are removed from the bed 6 and conveyed into the oven 12 in which the powder turns into a film and forms the desired coating.

The terms and expressions used here are purely descriptive and apply no limitations. There is no intention, in the use of these terms, to exclude any equivalent to the hardware described and it is therefore recognized that modifications are possible while at the same time remaining within the scope of the invention.

What is claimed is:

1. Method for covering an object with a film resulting from the melting of a thin layer of powder, in which method:

(a) a bed of electrostatic fluidized powder is arranged in a vat, the powder being charged by a tribocharging device comprising a honeycomb located in the vat wherein the honeycomb comprises prisms or vertical tubes open at both ends, (b) the object is dipped into the vat in order to cover it with powder, by electro-deposition, (c) the object, covered with the powder, is then placed in an oven at a high enough temperature that a coating film can be obtained by melting the powder.

2. Method according to claim 1, in which the powder is made of polyamide 11 or polyamide 12.

3. Method according to claim 1, in which the honeycomb tubes are covered on the outside with a conducting material or metallic paint.

4. Method according to claim 3, in which the walls of the tubes of the honeycomb are pierced with holes to facilitate removal of charges from the inside to conducting exterior surfaces of the tubes.

5. Method according to claim 3, in which the walls of the tubes contain conducting elements for removing charges from the inside to conducting exterior surfaces of the tubes.

6. Method according to claim 1, in which the object to be coated is first covered with a powder primer, and is then passed through an oven to bake the primer, then immersed in the vat to be covered with the electrostatic fluidized powder.

7. Method according to claim 6, in which the coating with powdered primer is performed in a bed of the electrostatic fluidized powder comprising the electrostatic fluidized powder of (a) and at least 1% by weight of primer.

8. Method according to claim 6, in which a prior coating with primer is performed in a bed of electrostatic fluidized powder, this powder being charged by a tribocharging device.

9. A method according to claim 1, wherein the fluidized powder is a polyamide, a polyolefin, an epoxy or a polyester.

10. A method according to claim 1, wherein a charging system of the method does not use electrodes connected to a source of electrical energy.

11. A method according to claim 1, wherein the powder has a size of 0.01–1 mm.

12. A method according to claim 4, wherein the holes are 0.05–2 mm in diameter.

13. A method according to claim 1, wherein the object comprises aluminum, steel, or alloys thereof.

14. A method according to claim 7, wherein the electrostatic fluidized powder comprises 5–10% by weight of primer.

15. Apparatus for covering an object by electrostatic deposition comprising a powder-fluidization vat and a honeycomb inside the vat, wherein the honeycomb comprises prisms or tubes being arranged vertically wherein the honeycomb is not connected to a source of electricity and the honeycomb is a tribocharging device for sufficient electrostatistically charging powder within the fluidization vat to coat the object by electrodeposition.

16. A method for covering an object, comprising arranging a bed of fluidized powder in a vat, wherein the powder is charged by a tribocharging device comprising honeycomb tubes covered on the outside with a conducting material or metallic paint located in the vat, dipping the object into the vat To cover the object with the charged powder by electrodeposition; and heating the powder covered object to melt the powder to obtain a covering film.

17. A method for covering an object comprising:

arranging a bed of charged fluidized powder in a vat wherein the powder is charged by circulating the powder through a tribocharging device located outside the bed prior to being introduced into the bed;

dipping an object into the vat of charged powder to cover the object with the charged powder by electrodeposition; and hearing the powder covered object to melt the powder to obtain a coating film.

18. An apparatus for coating an object, comprising:

a powder-fluidization vat for containing a bed of fluidized powder, a tribocharging device outside of the bed wherein the tribocharging device is in communication with the powder to charge the powder circulating through the tribocharging device, and introduce the charged powder into the bed of fluidized powder, and means for dipping the object into the charged powder of the bed of fluidized powder.

* * * * *

UNITED STATES PATENT AND TRADEMARK OFFICE

CERTIFICATE OF CORRECTION

PATENT NO. : 6,506,455 B1 
DATED : January 14, 2003
INVENTOR(S) : Ariel Bru et al.

It is certified that error appears in the above-identified patent and that said Letters Patent is hereby corrected as shown below:

Title page, Item [54] and Column 1, line 1,
Reads "FLUIDIZDED" should read -- FLUIDIZED --

Column 10,
Line 16, reads "the vat To cover" should read -- the vat to cover --
Line 28, reads "hearing the powder" should read -- heating the powder --

Signed and Sealed this

Sixteenth Day of September, 2003

JAMES E. ROGAN
*Director of the United States Patent and Trademark Office*